US009227404B2

(12) United States Patent
Furukawa

(10) Patent No.: US 9,227,404 B2
(45) Date of Patent: Jan. 5, 2016

(54) LIQUID EJECTION HEAD AND METHOD FOR FABRICATING THE SAME

(71) Applicant: CANON KABUSHIKI KAISHA, Tokyo (JP)

(72) Inventor: Masao Furukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/259,518

(22) Filed: Apr. 23, 2014

(65) Prior Publication Data

US 2014/0333692 A1 Nov. 13, 2014

(30) Foreign Application Priority Data

May 8, 2013 (JP) ..... 2013-098790

(51) Int. Cl.
*B41J 29/393* (2006.01)
*B41J 2/145* (2006.01)
*B41J 2/16* (2006.01)

(52) U.S. Cl.
CPC .. *B41J 2/145* (2013.01); *B41J 2/16* (2013.01); *B41J 2/1603* (2013.01); *B41J 2/1623* (2013.01); *B41J 2/1632* (2013.01); *Y10T 29/49401* (2015.01)

(58) Field of Classification Search
CPC ..... B41J 29/393; B41J 29/38; B41J 29/02; B41J 11/42; B41J 2/04505; B41J 13/02
See application file for complete search history.

(56) References Cited

U.S. PATENT DOCUMENTS 8,919,908 B2 * 12/2014 Silveston-Keith et al. ..... 347/16
2011/0225824 A1 9/2011 Furukawa

FOREIGN PATENT DOCUMENTS

JP 2002-079676 A 3/2002

* cited by examiner

*Primary Examiner* — Lamson Nguyen
(74) *Attorney, Agent, or Firm* — Fitzpatrick, Cella, Harper & Scinto

(57) ABSTRACT

There is provided a liquid ejection head that can reduce trouble in alignment of a print element substrate even in the case where a high magnification optical system is used and a method for fabricating the liquid ejection head. To achieve this, an auxiliary mark that indicates a relative position with respect to a reference mark is detected and recognized, and thus the position of the reference mark is identified even in the case where the reference mark is not reflected in a camera.

19 Claims, 12 Drawing Sheets

LIQUID EJECTION HEAD AND METHOD FOR FABRICATING THE SAME

BACKGROUND OF THE INVENTION

1. Field of the Invention

The present invention relates to a liquid ejection head applied to a printing apparatus that ejects liquid such as ink to perform printing and to a method for fabricating the same.

2. Description of the Related Art

Liquid ejection printing apparatuses (hereinafter also simply referred to as printing apparatuses) are widely used as output devices or the like for computers and a wide variety of printing apparatuses are being produced on a commercial basis. Printing methods for such printing apparatuses include a method that uses an electrothermal transducer as an ejection energy generator. A liquid ejection head built in a printing apparatus that uses the method has an electrothermal transducer provided in a pressurizing chamber of a print element substrate and an electrical pulse which serves as an ejection signal is applied to the transducer to provide thermal energy to liquid such as ink, and uses bubble pressure generated in boiling of the liquid to eject the liquid.

In a liquid ejection head used for such a liquid ejection printing apparatus, a plurality of print element substrates is arrayed and bonded to a base plate. In order to precisely dispose the respective print element substrates, reference marks are provided on the print element substrates and the reference marks are optically photographed and recognized for alignment. In the alignment, the print element substrate is sucked onto a vacuum finger (hereinafter also simply referred to as a finger) and photographed from above with two CCD cameras. The reference mark includes a circular portion and four rectangular portions, all of which are used as one mark.

While increasing a photographing magnification ratio of the optical system is effective for more accurately disposing the plurality of print element substrates, the increase of the photographing magnification ratio could cause the following problems.

In the case where the photographing magnification ratio of the optical system is increased in order to perform more accurate alignment, the photographing region becomes narrow accordingly. Furthermore, variations in the outside dimensions of the print element substrates and variations in stop precision of the print element substrate transport system before the print element substrates are sucked onto the finger cause variations also in the relative positional relationship between the finger and the reference marks provided on the print element substrates.

For this reason, in the case where the photographing region narrows at the first photographing after a print element substrate is sucked onto the finger, a reference mark does not exist in the photographing region, which may disable alignment of the print element substrate.

Furthermore, even in the case where the photographing magnification ratio is increased and the rectangular portions of the reference mark are included in the photographing region, it takes long time to perform alignment of the print element substrate because the direction in which the circular portion of the reference mark exists cannot be known.

While a conventional technique such as the one described in Japanese Patent Laid-Open No. 2002-79676 sufficiently satisfied the image quality requirements in the past, more accurate alignment becomes necessary in order to satisfy the image quality demanded now and in the future.

SUMMARY OF THE INVENTION

In light of the problems stated above, an object of the present invention is to provide a liquid ejection head that can reduce trouble in alignment of a print element substrate even in the case where a high magnification optical system is used and a method for fabricating the same.

To achieve the object, a liquid ejection head of the present invention which includes a print element substrate for ejecting liquid includes at least one reference mark which is provided on the print element substrate and used as a reference in alignment of the print element substrate, and an auxiliary mark which is provided on the print element substrate corresponding to the reference mark and includes information indicating a relative position with respect to the reference mark.

According to the present invention, a liquid ejection head includes a reference mark and an auxiliary mark indicating a relative position of the reference mark and thereby can reduce trouble in alignment of a print element substrate even in the case where a high magnification optical system is used.

Further features of the present invention will become apparent from the following description of exemplary embodiments (with reference to the attached drawings).

DESCRIPTION OF THE EMBODIMENTS

First Embodiment

A first embodiment of the present invention will be described below with reference to drawings.

Figure 1:
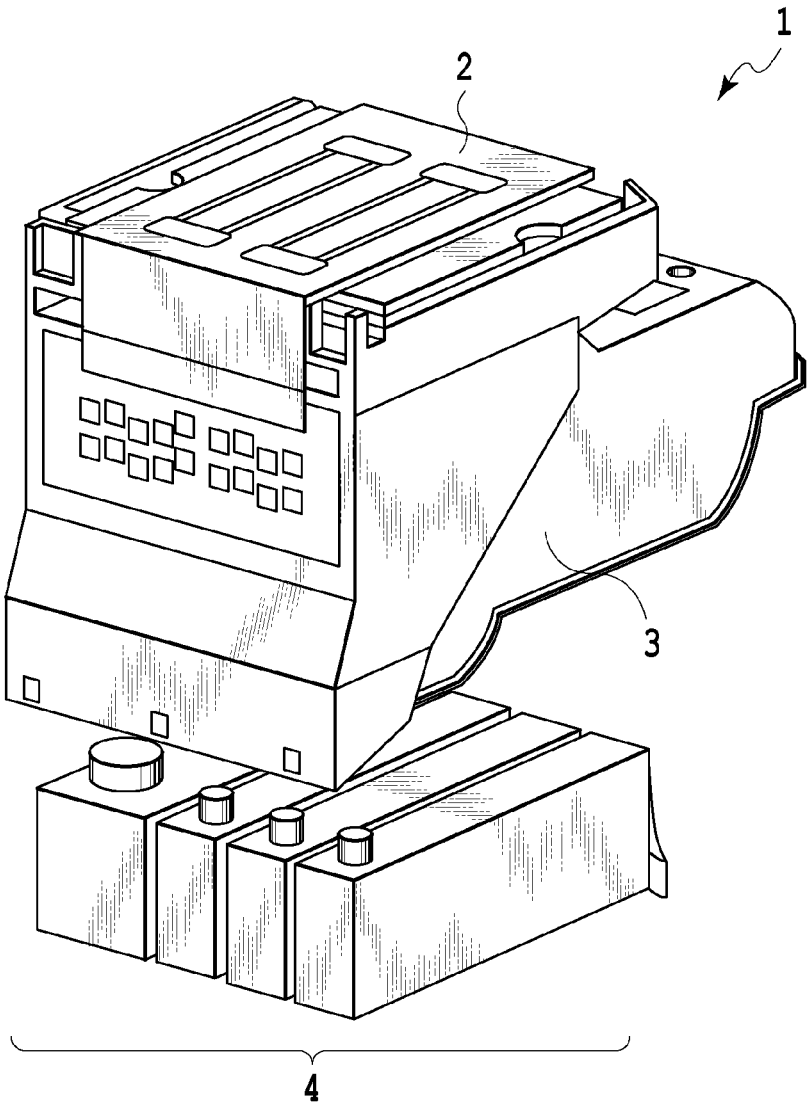
FIG. 1 is a perspective view of a liquid ejection head.
Figure 2A:
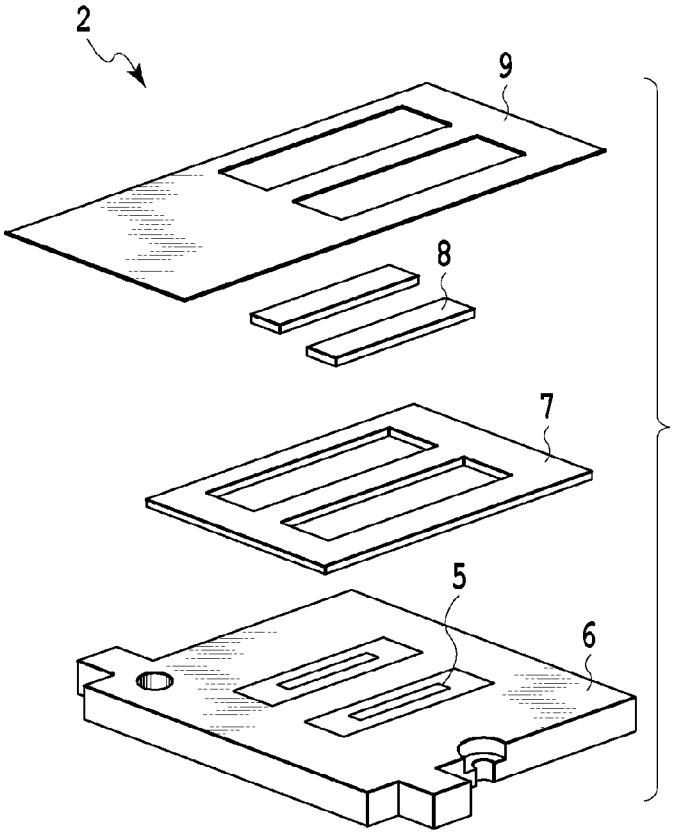
FIG. 2A is a perspective view of a print element unit.
Figure 2B:
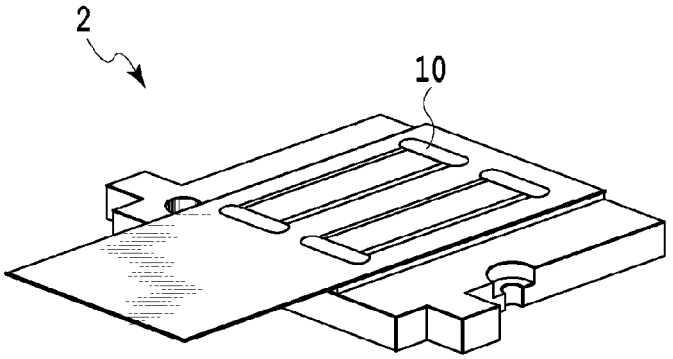
FIG. 2B is a perspective view of the print element unit.

FIG. 1 is a perspective view of a liquid ejection head (hereinafter also referred to as the print head) ejecting liquid such as ink in the present embodiment; FIGS. 2A and 2B are perspective views of a print element unit constituting the print head. A print head 1 includes a tank holder 3 containing a plurality of ink tanks 4 and a print element unit 2 attached to the tank holder 3.

As illustrated In FIG. 2A, the print element unit 2 includes an auxiliary plate 7, two print element substrates 8, and an electric wiring plate 9 which are bonded to a supporting plate 6 in which ink supply ports 5 are formed. After completion of the bonding of these components, the print element unit 2 appears as illustrated in FIG. 2B. Reference numeral 10 in FIG. 2B indicates sealant applied for protecting a portion which electrically connects an electrical connection part (not illustrated) of the electric wiring plate 9 and an electrical connection part (not illustrated) of the print element substrates 8.

Note that while two print element substrates 8 that are identical in geometry are mounted in the print element unit 2 in FIGS. 2A and 2B, the print head may mount print element substrates having different geometries and the number of print element substrates 8 is not limited to two, but may be one or three or more.

Figure 3A:
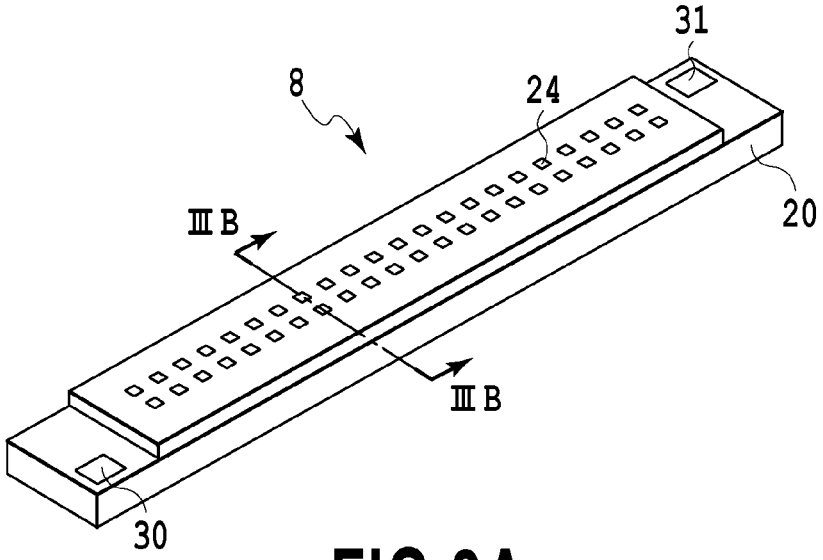
FIG. 3A is an external perspective view of a print element substrate.
Figure 3B:
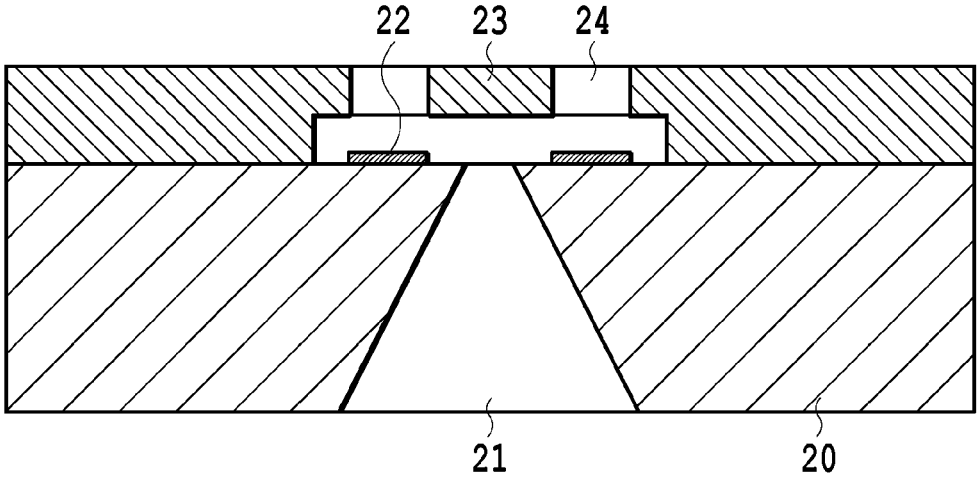
FIG. 3B is a cross-sectional view of the print element substrate.

Subsequently, the print element substrate will now be described with reference to FIGS. 3A and 3B. FIG. 3A is an external perspective view of the print element substrate and FIG. 3B is a schematic cross-sectional view illustrating IIIB-IIIB cross-section of FIG. 3A. The print element substrate 8 includes a silicon substrate 20 and an ink supply port 21 which passes through the silicon substrate 20 from the obverse side to the reverse side thereof is provided in the center of the silicon substrate 20. A plurality of electrothermal transducers 22, which generates energy used for ejecting liquid, is disposed on the obverse side and bubble generation chambers 23 and ejection ports 24 are formed from a material such as resin so as to correspond to the electrothermal transducers 22.

Furthermore, mark parts 30 and 31 used for alignment in bonding the print element substrate 8 to the supporting plate 6 are formed at ends of the print element substrate 8. Note that a large number of the print element substrates 8 are formed on a substantially circular 8-inch sized silicon wafer and the silicon wafer is diced into individual print element substrates 8 with a dicing machine.

Figure 4A:
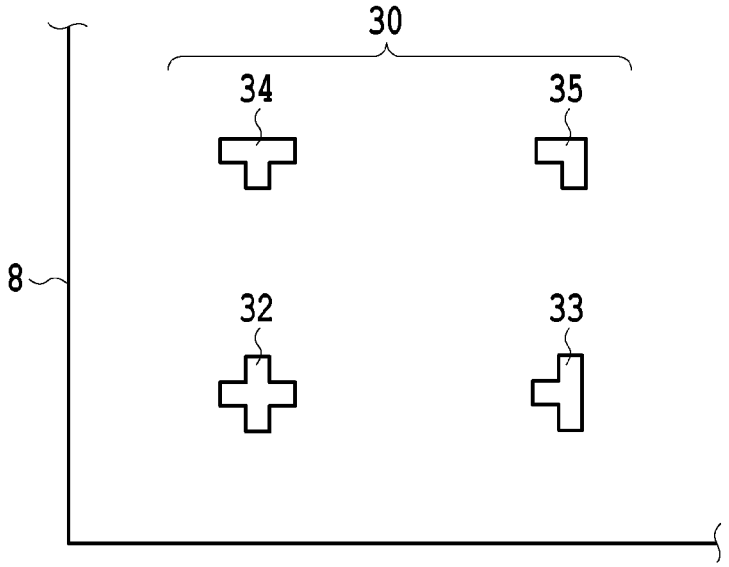
FIG. 4A is an enlarged view of a mark part and its periphery formed on the print element substrate.
Figure 4B:
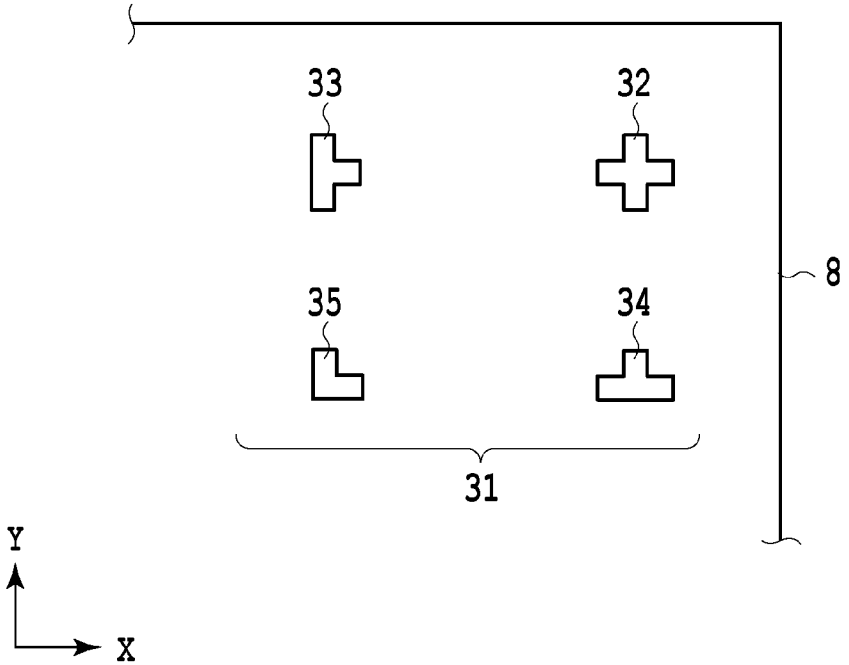
FIG. 4B is an enlarged view of a mark part and its periphery formed on the print element substrate.

The mark parts 30 and 31 will now be described. FIGS. 4A and 4B are enlarged views of mark parts and their peripheries formed on the print element substrate; FIG. 4A is an enlarged view of the mark part 30 and its periphery and FIG. 4B is an enlarged view of the mark part 31 and its periphery. A reference mark 32 serves as a mark for alignment in bonding the print element substrate 8 to the supporting plate 6, and the reference mark 32 is photographed and recognized by an optical system, which will be described later. One or more auxiliary marks 33 to 35 are provided adjacent to one reference mark and indicate the relative positions with respect to the reference mark 32.

The auxiliary marks 33, 34, and 35 are disposed at positions predetermined distances away from the reference mark 32 in an arrow X direction, in an arrow Y direction, and in both of the arrow X direction and the arrow Y direction, respectively. The predetermined distances will be described later together with the description of the optical system.

The reference mark 32 and the auxiliary marks 33 to 35 are disposed in a matrix as illustrated in the figures and the auxiliary marks 33 to 35 are disposed so as to surround the reference mark 32. The reference mark 32 and the auxiliary marks 33 to 35 are formed by depositing an aluminum material. Note that while the reference mark 32 and the auxiliary marks 33 to 35 are formed on the same plane in the present embodiment, all or some of the auxiliary marks may be formed from resin or other material as with formation of the ejection ports 24.

In that case, however, an image of the mark part photographed during alignment, which will be described later, will be somewhat out of focus because there is a difference in height between the reference mark 32 and the auxiliary marks formed from resin. Therefore, preferably the respective marks are formed on the same plane.

Figure 5A:
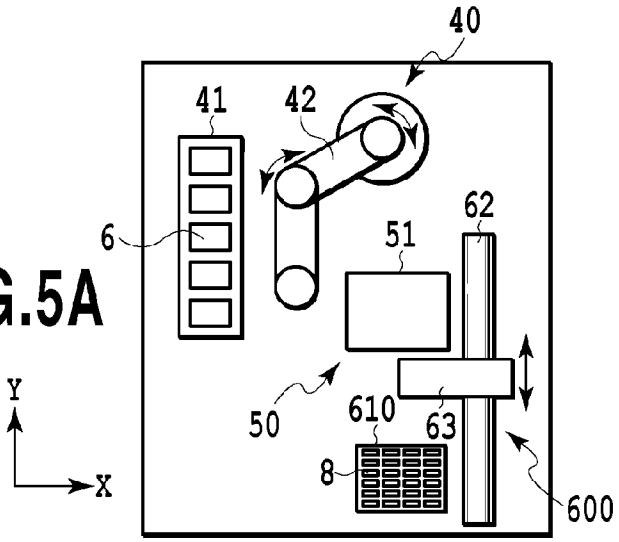
FIG. 5A is a diagram illustrating a mounter.

Next, a machine that is used in fabrication of the liquid ejection head for bonding the print element substrates 8 to the supporting plate (hereinafter the machine will be also referred to as a mounter) will be described with reference to FIGS. 5A to 5D. FIG. 5A is a plan view schematically illustrating a configuration of the mounter, which mainly includes a supporting plate transport unit 40, a supporting plate fixing unit 50, and a substrate transport unit 600. A plurality of supporting plates 6 before bonding is arrayed in a supporting plate tray 41 and transferred one by one from the supporting plate tray 41 onto a supporting plate fixing jig 51 by a supporting plate transport robot 42.

Figure 5B:
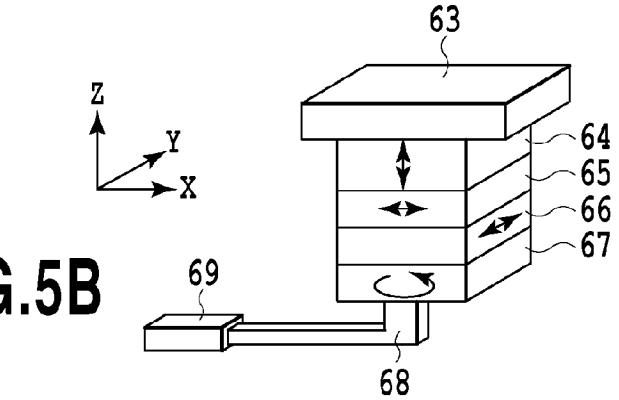
FIG. 5B is a diagram illustrating the mounter.
Figure 5C:
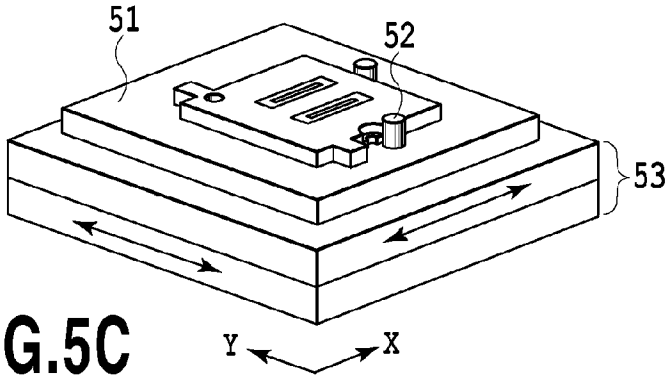
FIG. 5C is a diagram illustrating the mounter.

Note that while the supporting plates 6 are arrayed in the supporting plate tray 41 with an adhesive applied beforehand to the supporting plates 6 in the present embodiment, the adhesive may be applied in the mounter. FIG. 5B is a diagram illustrating the supporting plate fixing unit 50. The supporting plate fixing unit 50 includes an XY-stage 53 on which the supporting plate fixing jig 51 is attached, and is configured to fix a supporting plate by abutting the supporting plate against pins 52. FIG. 5C is a diagram illustrating the substrate transport unit 600.

The substrate transport unit 600 includes a substrate transport robot 62 with a movable table 63 which reciprocates between the supporting plate fixing unit 50 and above the substrate tray 610 and on which a Z-stage 64, an X-stage 65, a Y-stage 66, and a θz-stage 67 are mounted in this order from the top. An arm 68 is attached to the θz-stage 67 and a finger 69 which sucks and holds the print element substrate 8 is attached at the tip of the arm 68. The print element substrates 8 are arrayed in the substrate tray 610 and are one by one sucked onto and held by the finger 69 and transported to above the supporting plate fixing jig 51.

Figure 5D:
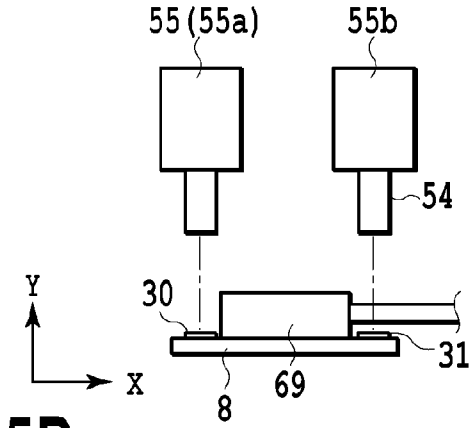
FIG. 5D is a diagram illustrating the mounter.

FIG. 5D is a diagram illustrating lenses 54 and cameras 55 above the supporting plate fixing jig 51. Two sets of lens 54 and camera 55 for photographing the mark parts 30 and 31 formed on the print element substrate 8 sucked onto and held by the finger 69 are placed above the supporting plate fixing jig 51. The positions where cameras 55*a* and 55*b* are placed are accurately adjusted so that the print element substrate is placed at the position where the print element substrate is to be bonded to the supporting plate 6 in the case where each reference mark 32 is reflected in the center of each of the cameras 55*a* and 55*b*.

Moreover, in order to achieve highly accurate alignment, according to the specification of the optical system, the camera 55 includes a photographing element having a cell size of 7.4 μm square, and has 656 effective pixels in the arrow X direction and 492 effective pixels in the arrow Y direction. The lens 54 built in the camera 55 mounts a lens capable of magnifying by 6 times. In this specification, a photographing resolution is approximately 1.23 μm per pixel in both of the arrow X direction and the arrow Y direction, which enables highly accurate alignment. The size of a photographing region is approximately 0.8 mm in the arrow X direction and approximately 0.6 mm in the arrow Y direction.

The positional relationships between the reference mark 32 and the auxiliary marks 33 to 35 in each of the mark parts 30 and 31 of the print element substrate 8 will now be described with reference to FIGS. 4A and 4B. The center of the reference mark 32 is 0.6 mm away from the center of the auxiliary mark 33 in the arrow X direction. Similarly, the auxiliary mark 34 is 0.6 mm away from the auxiliary mark 35 in the arrow X direction, and the reference mark 32 is 0.4 mm away from the auxiliary mark 34 in the arrow Y direction. With respect to the auxiliary marks 33 and 34, the reference mark 32 is provided in a direction of protrusion of each of the auxiliary marks 33 and 34; with respect to the auxiliary mark 35, the reference mark 32 is provided in a direction of the rectangularly cut portion (oblique direction). This means that the auxiliary marks include information indicating the relative positions with respect to the reference mark.

With such positional relationships, in a case of photographing the mark parts 30 and 31 with the optical system according to the previously described specification, at least one of the reference mark 32 and the auxiliary marks 33 to 35 is photographed in the photographed image of at least one of the cameras 55*a* and 55*b*.

Figure 6:
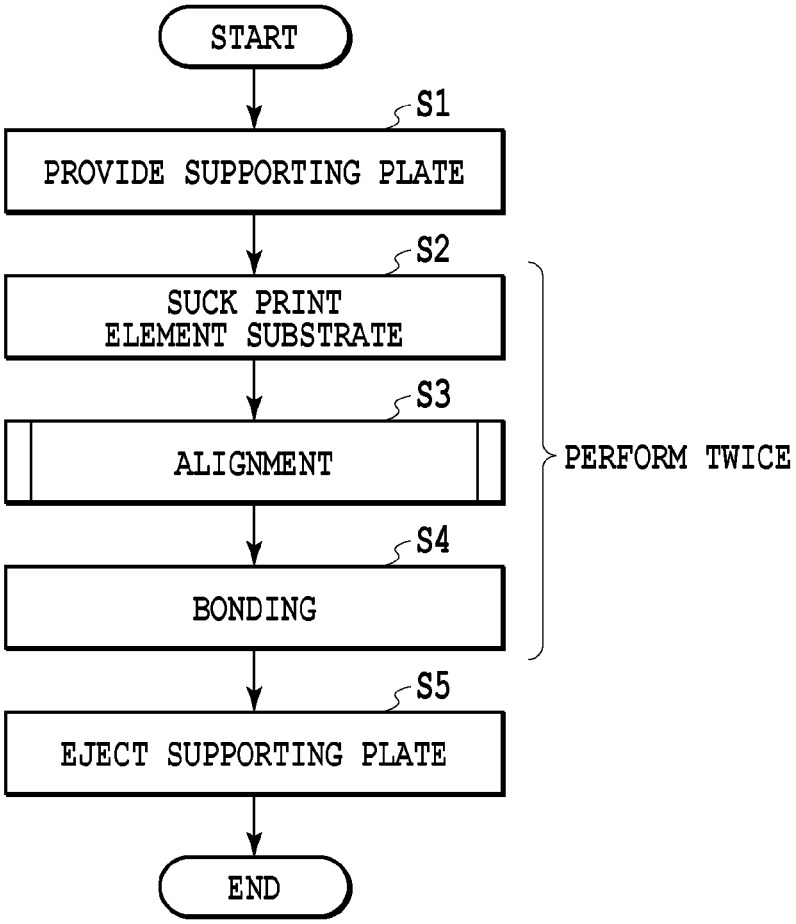
FIG. 6 is a flowchart illustrating a process for bonding the print element substrate to a supporting plate.

FIG. 6 is a flowchart illustrating a process for bonding the print element substrate 8 to the supporting plate 6. The process for bonding the print element substrate 8 to the supporting plate 6 will be described below with reference to the flowchart. In the case where the process for bonding the print element substrate 8 to the supporting plate 6 is started, one of the supporting plates 6 arrayed in the supporting plate tray 41 is picked up and mounted on the supporting plate fixing jig 51 by the supporting plate transport robot 42 at step S1. Then, at step S2, the substrate transport robot 62 is activated to move the movable table 63 to above the substrate tray 61 and the print element substrate 8 is sucked onto and held by the finger 69.

Then, alignment of the print element substrate 8 is performed at step S3. A detailed description of step S3 will be separately provided later. Then, at step S4, the Z-stage 64 is lowered to bond the print element substrate 8 to the supporting plate 6. Since the print head of the present embodiment includes two print element substrates 8, step S2 to step S4 are performed twice.

Note that before bonding of the second print element substrate 8, the XY-stage 53 of the supporting plate fixing unit 50 is activated to move the supporting plate 6 so as to bond the second print element substrate 8 to a predetermined position. Lastly, at step S5, the supporting plate 6 after completion of the bonding is ejected into the supporting plate tray 41 by the supporting plate transport robot 42 to complete the process.

Figure 7:
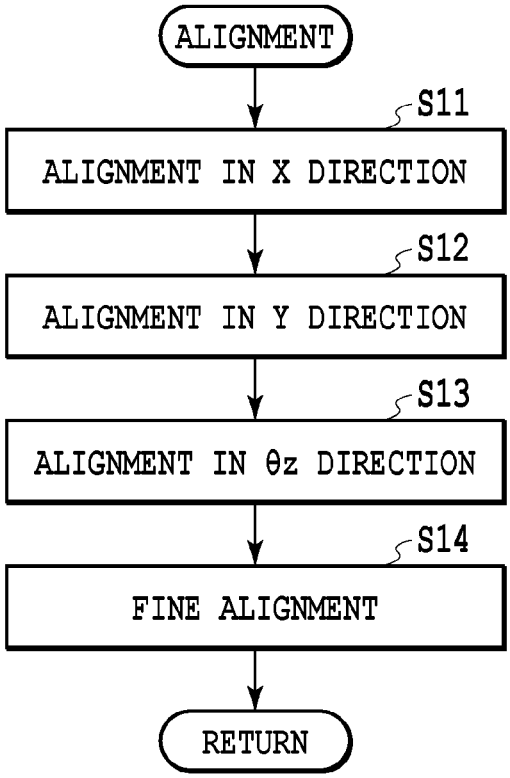
FIG. 7 is a flowchart illustrating an alignment operation.

FIG. 7 is a flowchart illustrating the alignment operation at step S3 of FIG. 6. FIGS. 8A to 8E are schematic diagrams illustrating images photographed by the cameras 55*a* and 55*b* during alignment. Details of the alignment operation at step S3 of FIG. 6 will now be described with reference to FIG. 7 and FIGS. 8A to 8E.

Figure 8A:
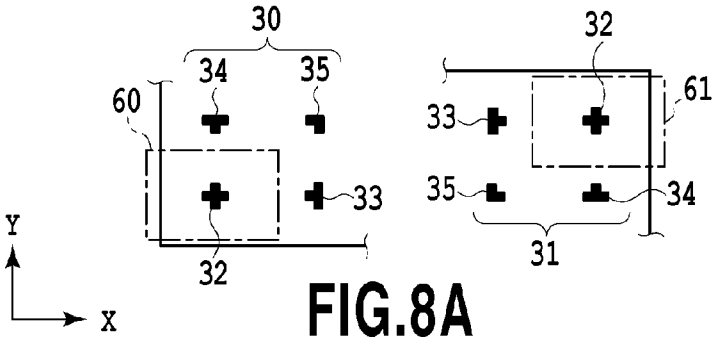
FIG. 8A is a diagram illustrating images photographed by a camera.

In FIGS. 8A to 8E, photographed images 60 indicated by dashed boxes represent images photographed with the camera 55*a* and photographed images 61 indicated by dashed boxes represent images photographed with the camera 55*b*. FIG. 8A illustrates a state after completion of the entire process in the flowchart of FIG. 7, in which the position of the print element substrate 8 is adjusted so that the reference mark 32 in the mark part 30 is reflected substantially in the center of the photographed image 60 and the reference mark 32 in the mark part 31 is reflected substantially in the center of the photographed image 61.

Note that the geometries of the marks 32 to 35 have been pattern-registered in an unillustrated image processing apparatus beforehand and a pattern searching function of the image processing apparatus is used to detect and recognize which mark exists and where in a photographed image.

Figure 8B:
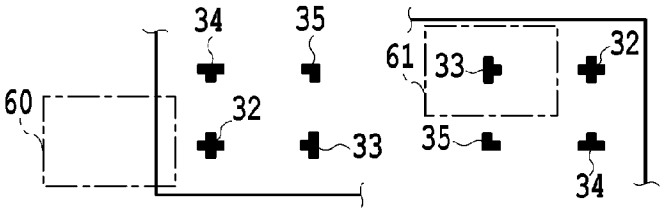
FIG. 8B is a diagram illustrating images photographed by the camera.

Upon start of the alignment, first at step S11, the position of the print element substrate 6 is adjusted in the arrow X direction. FIG. 8B illustrates one example of a state where the mark parts 30 and 31 are photographed for the first time. FIG. 8B represents an exemplary state in which the print element substrate 8 is deviated to the right and therefore none of the reference mark 32 and the auxiliary marks 33 to 35 are photographed in the photographed image 60, whereas the auxiliary mark 33 is reflected in the photographed image 61.

This phenomenon is due to the relative positional relationship in the case where the print element substrate 8 is sucked onto and held by the finger 69 and the cause thereof can be cited as follows. As has been descried earlier, the print element substrate 8 has been diced from a silicon wafer and there are variations in outside dimensions of individual print element substrates 8 due to the precision of the dicing.

Accordingly, there are variations in the positions of the print element substrates 8 in the substrate tray 61 in the case where the print element substrates 8 are placed in the substrate tray 61, resulting in variations in the relative positions of the print element substrates 8 and the finger 69. Since the amounts of the variations can be somewhat greater than the photographing region of the optical system, the phenomenon that the reference mark 32 is not reflected in the photographed image 60 or 61 may occur.

Figure 8C:
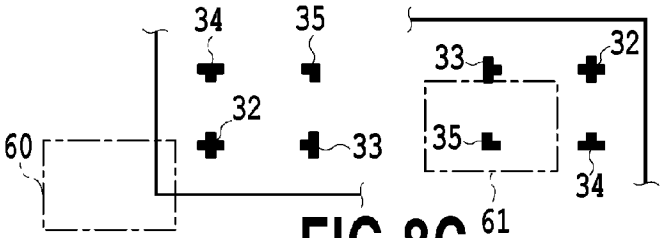
FIG. 8C is a diagram illustrating images photographed by the camera.

FIG. 8C illustrates a state where the print element substrate 8 is deviated also upward in addition to the right and, in this case, the auxiliary mark 35 is reflected in the photographed image 61. In the case as illustrated in FIG. 8B or 8C, the X-stage 65 is controlled so as to move the print element substrate 8 leftward, thereby allowing the reference mark 32 or the auxiliary mark 34 to be reflected in the photographed image 61. Note that while the case where the print element substrate 8 is deviated to the right is described above, in the case of leftward deviation, in a manner opposite to the above, the reference mark 32 or the auxiliary mark 34 is allowed to be reflected in the photographed image 60.

Figure 8D:
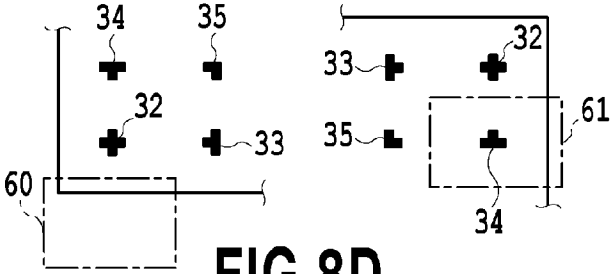
FIG. 8D is a diagram illustrating images photographed by the camera.
Figure 8E:
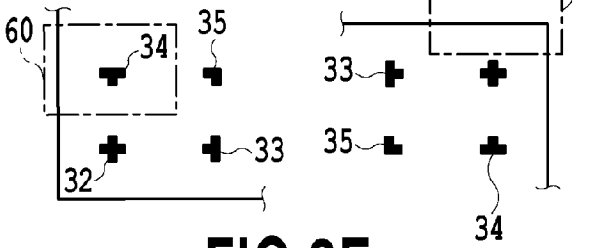
FIG. 8E is a diagram illustrating images photographed by the camera.

Then, at step S12, the print element substrate 8 is moved in the Y direction. FIG. 8D illustrates a state where the auxiliary mark 34 is reflected in the photographed image 61, and in this case, the Y-stage 66 is controlled to move the print element substrate 8 downward so as to allow the reference mark 32 to be reflected in the photographed image 61. In contrast, in the case where the auxiliary mark 34 is reflected in the photographed image 60 as in FIG. 8E, the Y-stage 66 is moved upward so as to allow the reference mark 32 to be reflected in the photographed image 60.

Then, adjustments in the rotational (θz) directions are made at step S13: the θz-stage 67 is adjusted so as to allow the reference mark 32 to be reflected in both of the photographed images 60 and 61. Lastly, fine adjustments of the stages 65 to 67 are made at step S14 so that each reference mark 32 is reflected in the center of each of the photographed images 60 and 61 as illustrated in FIG. 8A, thereby completing the alignment.

Thus, a liquid ejection head can be realized that can reduce trouble in alignment of a print element substrate by detecting and recognizing auxiliary marks without an interruption of the alignment operation even in the case where a reference mark is not reflected in cameras at the first photographing.

Second Embodiment

A second embodiment of the present invention will be described below with reference to drawings. Note that the basic configuration of the present embodiment is the same as that of the first embodiment and therefore only the characteristic configuration will be described below.

While the geometries of the auxiliary marks are pattern-registered in the image processing apparatus and individual patterns are searched for in the first embodiment, an example will be described in the present embodiment in which pattern registration of and pattern searching for auxiliary marks are not performed will be described. The configuration of the present embodiment differs from that of the first embodiment as auxiliary marks in mark parts 30 and 31 on print element substrates 8.

Figure 9A:
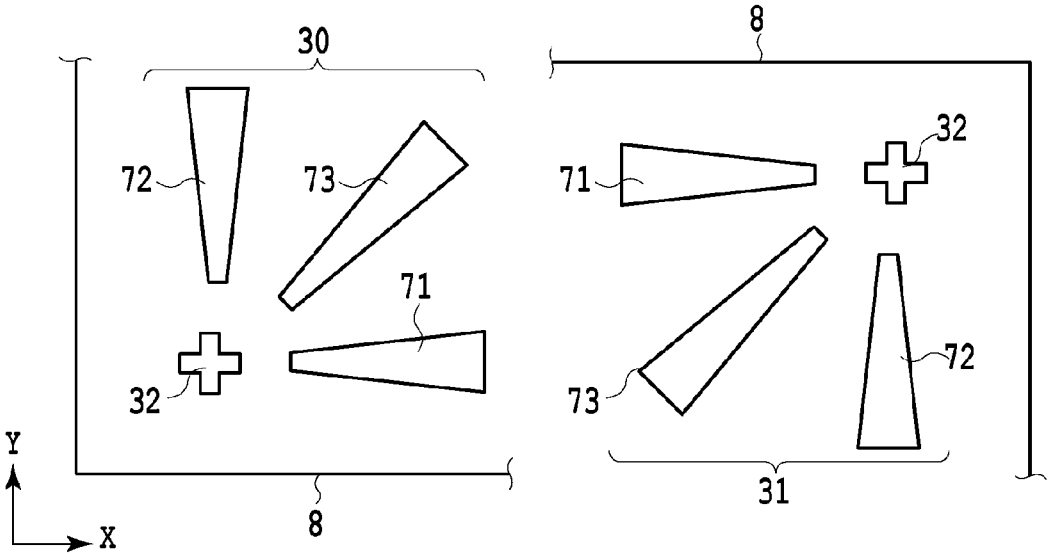
FIG. 9A is an enlarged view of a mark part and its periphery on the print element substrate.
Figure 9B:
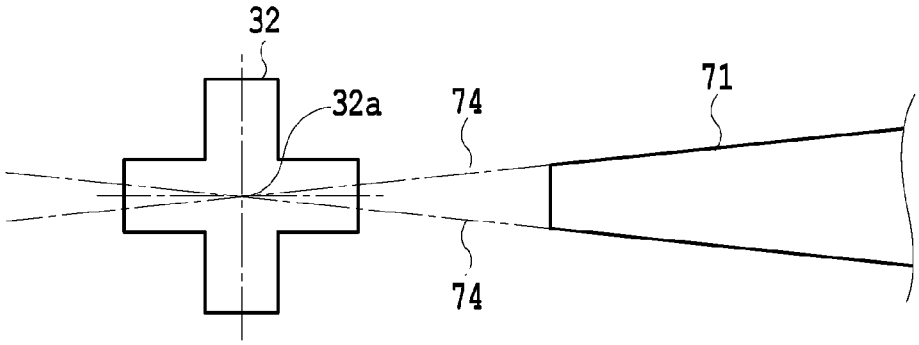
FIG. 9B is an enlarged view of a region of the mark part and its periphery on the print element substrate.

FIG. 9A is an enlarged view of mark parts and their peripheries on a print element substrate 8 in the present embodiment; auxiliary marks 71 to 73 have the same trapezoidal geometry but differ in orientation. FIG. 9B is an enlarged view of a reference mark 32 and a portion of the auxiliary mark 71; the inclinations of the oblique sides of the trapezoidal geometry of the auxiliary mark 71 are such that an intersection of imaginary lines 74 extended from the two oblique sides coincides with the center 32*a* of the reference mark 32.

Figure 10A:
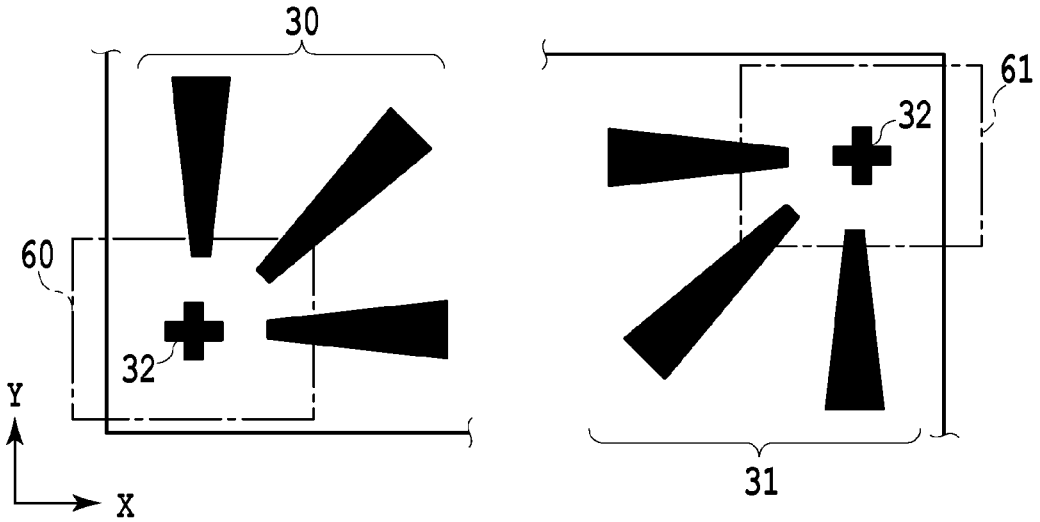
FIG. 10A is a schematic diagram of photographed images during alignment.
Figure 10B:
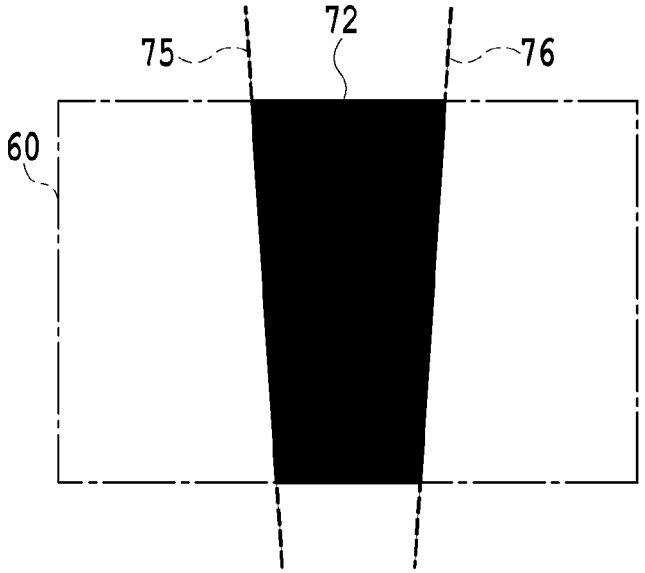
FIG. 10B is a schematic diagram of photographed images during alignment.

Alignment of the present embodiment will now be described. FIGS. 10A and 10B are schematic diagrams of photographed images during alignment. Upon completion of the alignment, each reference mark 32 is reflected in each of the photographed images 60 and 61 as illustrated in FIG. 10A. FIG. 10B illustrates one example of a photographed image photographed first and a portion of the auxiliary mark 72 (a partial image) is reflected in the photographed image 60.

In such a case, an edge detection function of an image processing apparatus for detecting contrast differences is used to detect the oblique sides of the auxiliary mark 72 as illustrated in FIG. 10B and the position of an intersection where extension lines 75 and 76 of the oblique sides intersect is calculated. Since the position of the intersection coincides with the center of the reference mark 32 as noted previously, the amount of movement of each of the stages 65 to 67 can be obtained, which allows prompt alignment.

While the case where a portion of the auxiliary mark 72 is reflected in the photographed image is described in the example described above, the position of the reference mark 32 can be obtained similarly by calculating an intersection of extension lines of the oblique sides in the case where a portion of another auxiliary mark 71 or 73 is reflected in a photographed image.

Thus, a liquid ejection head can be realized that can reduce trouble in alignment of a print element substrate because the position of a reference mark can be identified by detecting the inclinations of the oblique sides of an auxiliary mark even in the case where a reference mark is not reflected in cameras at the first photographing.

Third Embodiment

A third embodiment of the present invention will be described below with reference to drawings. Note that the basic configuration of the present embodiment is the same as that of the first embodiment and therefore only the characteristic configuration will be described below.

While examples in which two mark parts exist on a print element substrate have been described in the first and second embodiments, an example will be described in the present embodiment in which only one mark part exists. The configuration of the present embodiment is the same as that of the first embodiment, except that only a mark part 30 exists on a print element substrate 8 and that a different alignment method is used.

Figure 11A:
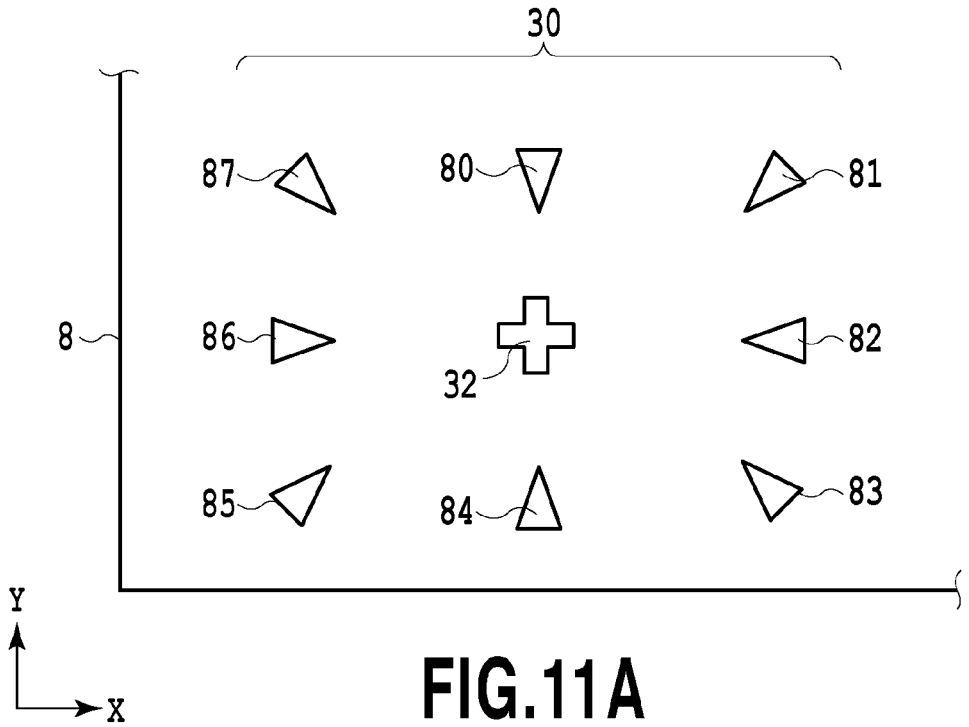
FIG. 11A is an enlarged view illustrating a mark part and its periphery on the print element substrate.
Figure 11B:
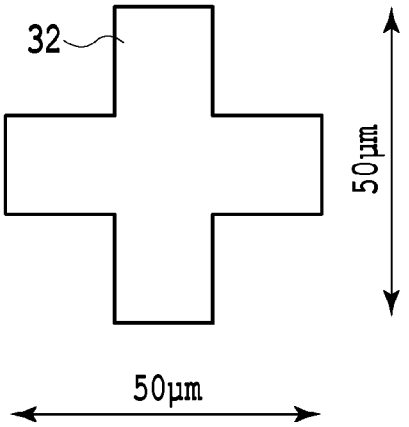
FIG. 11B is an enlarged view illustrating a mark part and its periphery on the print element substrate.
Figure 11C:
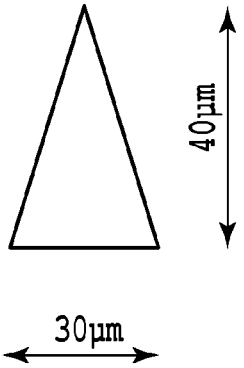
FIG. 11C is an enlarged view illustrating a mark part and its periphery on the print element substrate.

FIG. 11A is an enlarged view of a mark part 30 and its periphery of a print element substrate 8 of the third embodiment; as indicated by 80 to 87, auxiliary marks have the same isosceles triangular geometry but all of them differ from one another in orientation. Each of the auxiliary marks 80 to 87 is formed so that a vertex angle (the angle between the equal sides) of the isosceles triangle points to the reference mark 32. As illustrated in FIGS. 11B and 11C, the outermost size of the reference mark 32 is 50 μm in both of the X and Y directions and each of the auxiliary marks 80 to 87 has a base of 30 μm and a height of 40 μm.

Moreover, the distance between the reference mark 32 and each of the auxiliary marks 80 to 87 is uniformly 0.7 mm in the X direction and 0.5 mm in the Y direction and these nine marks are formed in a substantially matrix pattern. Note that the distances between the marks are the distances from the center of the reference mark 32 to the vertex of each of the auxiliary marks 80 to 87. The mark sizes and the positional relationships allow at least one of the reference mark 32 and the auxiliary marks 80 to 87 to be photographed in the case where the mark part 30 is photographed.

In the present embodiment, both of the geometry of the reference mark 32 and the isosceles triangular geometry of each of the auxiliary marks 80 to 87 are pattern-registered beforehand in an image processing apparatus and both of the patterns are pattern-searched in a photographed image. The searching performed here is searching capable of detecting any of the registered geometries reflected in any orientation in a photographed image and also capable of providing the orientation of a detected pattern as a result of the searching.

Alignment of the present embodiment will now be described with reference to FIGS. 12A to 12D, which are schematic diagrams of photographed images during alignment. FIG. 12A illustrates one example of a photographed image in the case where the mark part 30 has been photographed for the first time and the auxiliary mark 80 is reflected in the photographed image 60. Since it can be recognized from the result of the pattern searching that the vertex of the auxiliary mark 80 points downward in the figure in this case, it is possible to reflect the reference mark 32 by moving the print element substrate 8 upward by one field of view.

Figure 12C:
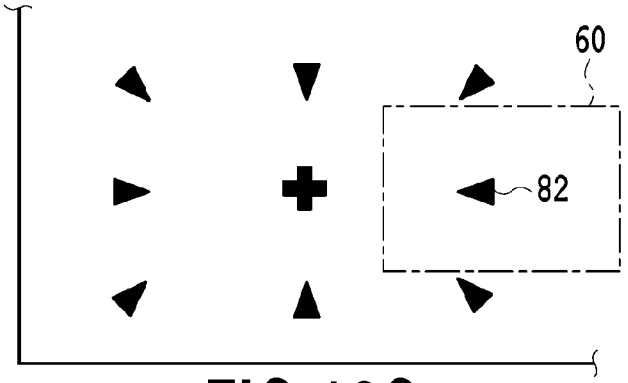
FIG. 12C is a schematic diagram of a photographed image during alignment.
Figure 12D:
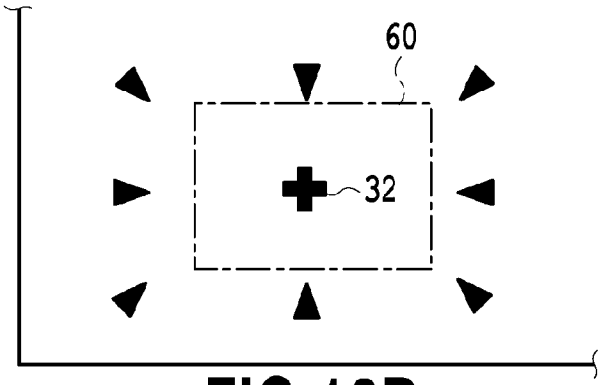
FIG. 12D is a schematic diagram of a photographed image during alignment.
Figure 12A:
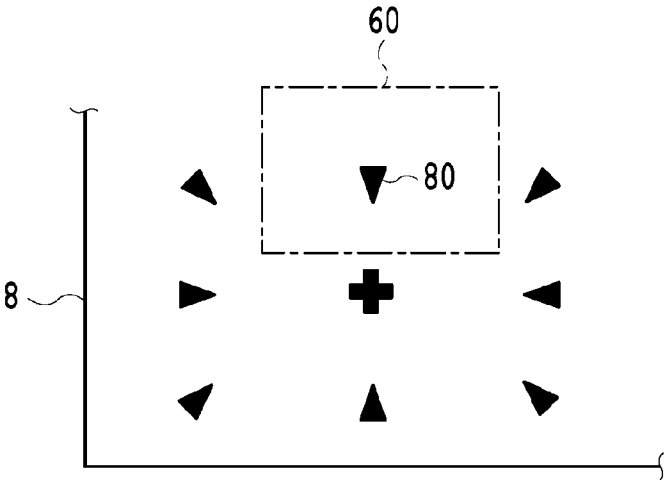
FIG. 12A is a schematic diagram of a photographed image during alignment.
Figure 12B:
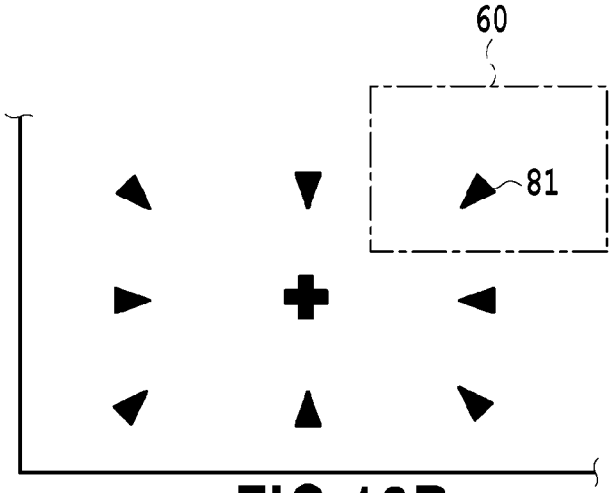
FIG. 12B is a schematic diagram of a photographed image during alignment.

Furthermore, in the case where the auxiliary mark 82 is detected as illustrated in FIG. 12B, the reference mark 32 is allowed to be reflected by moving the print element substrate 8 rightward and upward by one field of view; in the case where the auxiliary mark 81 is detected as illustrated in FIG. 12C, the reference mark 32 is allowed to be reflected by moving the print element substrate 8 rightward by one field of view. After the reference mark 32 has been detected, fine adjustments of the position of the print element substrate 8 are made so that the reference mark 32 is reflected substantially in the center of the photographed image 60 as illustrated in FIG. 12D.

While the cases where the auxiliary marks 80, 81 and 82 are reflected in a photographed image have been described in the example given above, the direction in which the print element substrate 8 is to be moved can be similarly determined from the orientation of the vertex of the isosceles triangle in the case where any of the other auxiliary marks 83 to 87 are reflected in a photographed image.

Thus, a liquid ejection head can be realized that can reduce trouble in alignment of a print element substrate because the position of a reference mark can be identified by detecting the orientation of the vertex of an auxiliary mark even in the case where a reference mark is not reflected in cameras at the first photographing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-098790, filed May 8, 2013, which is hereby incorporated by reference herein in its entirety.

What is claimed is:

1. A liquid ejection head having a print element substrate for ejecting liquid, comprising:

at least one reference mark provided on the print element substrate and used as a reference in alignment of the print element substrate; and an auxiliary mark provided on the print element substrate corresponding to the reference mark and including information indicating a relative position with respect to the reference mark, wherein the reference mark and the auxiliary mark differ in geometry.

2. The liquid ejection head according to claim 1, wherein one or more of the auxiliary marks are provided per the reference mark.

3. The liquid ejection head according to claim 1, wherein the auxiliary mark has a trapezoidal geometry.

4. The liquid ejection head according to claim 3, wherein the reference mark is positioned at an intersection of two imaginary lines extended from oblique sides of the auxiliary mark having the trapezoidal geometry.

5. The liquid ejection head according to claim 1, wherein the auxiliary mark has an isosceles triangular geometry.

6. The liquid ejection head according to claim 5, wherein the reference mark is positioned in a direction pointed by a vertex angle of the auxiliary mark having the isosceles triangular geometry.

7. The liquid ejection head according to claim 1, wherein the reference mark and the auxiliary mark are arranged in a matrix.

8. The liquid ejection head according to claim 1, wherein a plurality of elements generating energy used for ejecting liquid is formed on the print element substrate.

9. A liquid ejection head having a print element substrate for ejecting liquid, comprising:

at least one reference mark provided on the print element substrate and used as a reference in alignment of the print element substrate; and a plurality of auxiliary marks provided on the print element substrate corresponding to the reference mark and including information indicating a relative position with respect to the reference mark, wherein the plurality of the auxiliary marks differ from one another in geometry or orientation.

10. The liquid ejection head according to claim 9, wherein each of the auxiliary marks has a trapezoidal geometry.

11. The liquid ejection head according to claim 10, wherein the reference mark is positioned at an intersection of two imaginary lines extended from oblique sides of each of the auxiliary marks having the trapezoidal geometry.

12. The liquid ejection head according to claim 9, wherein each of the auxiliary marks has an isosceles triangular geometry.

13. The liquid ejection head according to claim 12, wherein the reference mark is positioned in a direction pointed by a vertex angle of each of the auxiliary marks having the isosceles triangular geometry.

14. The liquid ejection head according to claim 9, wherein the reference mark and the auxiliary marks are arranged in a matrix.

15. The liquid ejection head according to claim 9, wherein a plurality of elements generating energy used for ejecting liquid is formed on the print element substrate.

16. A method for fabricating a liquid ejection head mounting a print element substrate for ejecting liquid, in a predetermined position on a supporting plate, comprising the steps of:

photographing a reference mark provided on the print element substrate or an auxiliary mark provided in the vicinity of the reference mark;

detecting the reference mark or the auxiliary mark from the photographed image; and identifying a position of the reference mark from the detected auxiliary mark in a case where the reference mark is not detected in the photographed image.

17. The method for fabricating a liquid ejection head according to claim 16, wherein the step of detecting the reference mark or the auxiliary mark detects the reference mark and the auxiliary mark by pattern searching in which geometries of the respective marks are pattern-registered beforehand.

18. The method for fabricating a liquid ejection head according to claim 16, wherein the step of identifying the position of the reference mark identifies the position from a geometry or orientation of the auxiliary mark detected.

19. The method for fabricating a liquid ejection head according to claim 16, wherein the step of identifying the position of the reference mark includes the step of detecting inclination of the auxiliary mark from a photographed partial image of the auxiliary mark.

* * * * *